US009285774B2

(12) United States Patent
Rochat

(10) Patent No.: US 9,285,774 B2
(45) **Date of Patent: *Mar. 15, 2016**

(54) UNIVERSAL RUNNING EQUATION OF TIME MECHANISM AND METHOD OF SETTING THE SAME

(71) Applicant: Blancpain SA, Le Brassus (CH)

(72) Inventor: Marco Rochat, Le Brassus (CH)

(73) Assignee: Blancpain SA, Le Brassus (CH)

( * ) Notice: Subject to any disclaimer, the term of this patent is extended or adjusted under 35 U.S.C. 154(b) by 0 days.

This patent is subject to a terminal disclaimer.

(21) Appl. No.: 14/206,104

(22) Filed: Mar. 12, 2014

(65) Prior Publication Data

US 2014/0269219 A1 Sep. 18, 2014

(30) Foreign Application Priority Data

Mar. 12, 2013 (EP) ..... 13158766

(51) Int. Cl.
*G04B 19/23* (2006.01)
*G04B 19/26* (2006.01)

(52) U.S. Cl.
CPC ..... *G04B 19/23* (2013.01); *G04B 19/235* (2013.01); *G04B 19/262* (2013.01)

(58) Field of Classification Search
CPC ..... G04B 19/22; G04B 19/23; G04B 19/262; G04B 19/235
USPC ..... 368/14–20, 28, 34–38, 223–225, 228
See application file for complete search history.

(56) References Cited

U.S. PATENT DOCUMENTS 1,459,710 A * 6/1923 Balch ..... 368/17

(Continued)

FOREIGN PATENT DOCUMENTS

| | | |
|---|---|---|
| EP | 1 286 233 A1 | 2/2003 |
| EP | 1 343 056 A1 | 9/2003 |
| EP | 1 637 941 A1 | 3/2006 |

OTHER PUBLICATIONS

Machine Translation of Rochat, EP 1637941, Translated Jan. 5, 2015.*

(Continued)

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

Universal running equation of time mechanism including a differential device outputting a running equation minute which indicates the difference between civil time and solar time, the running equation minute driving a true running equation minute which drives a true running equation hour, a jumper spring cooperating with a star wheel connected to an arbor carrying a true running equation hour hand, a time zone wheel carrying the true running equation hour hand, a train making it possible to apply, to the true running equation hour, the time difference associated with the longitude position of a user, the time zone wheel making it possible to apply, to the arbor carrying the true running equation hour hand the difference between the true running equation hour and the civil hour at the place where the user is located.

5 Claims, 4 Drawing Sheets

(56) References Cited

U.S. PATENT DOCUMENTS

| | | | | |
|---|---|---|---|---|
| 5,184,333 | A * | 2/1993 | Caspar | 368/28 |
| 5,253,225 | A | 10/1993 | Vaucher | |
| 6,826,122 | B2 | 11/2004 | Zaugg | |
| 7,372,781 | B2 | 5/2008 | Loth | |
| 2003/0031093 | A1 * | 2/2003 | Zaugg | 368/80 |
| 2005/0207283 | A1 | 9/2005 | Loth | |
| 2005/0219959 | A1 | 10/2005 | Wiederrecht et al. | |
| 2012/0243380 | A1 * | 9/2012 | Goeller | 368/15 |
| 2012/0243388 | A1 * | 9/2012 | Goeller | 368/169 |

OTHER PUBLICATIONS

European Search Report issued in corresponding application 13158766, completed Aug. 14, 2013.

International Search Report issued in related application PCT/EP2013/053410, completed May 30, 2013 and mailed Jun. 6, 2013.

G. A. Berner, Illustrated Professional Dictionary of Horology I+II 639 (2002 Ed.).

G.-A. Gerner, Illustrated Professional Dictionary of Horology I + II , published in 1961 and 1995, pp. 225, 441, and 631.

* cited by examiner

UNIVERSAL RUNNING EQUATION OF TIME MECHANISM AND METHOD OF SETTING THE SAME

This application claims priority from European Patent Application No. 13158766.9 filed Dec. 3, 2013, the entire disclosure of which is incorporated herein by reference.

FIELD OF THE INVENTION

The present invention concerns a universal running equation of time mechanism. More specifically, the present invention concerns a running equation of time mechanism which accurately indicates the time at which the sun is at its zenith whatever the position, in terms of longitude, of the watch user relative to the centre of the time zone in which the user is situated.

BACKGROUND OF THE INVENTION

Within the same time zone, the sun is at its zenith at a different time depending on whether one is at the extreme east, at the centre or extreme west of the time zone. There is a time difference of 59 minutes between the two extreme positions.

Moreover, the country in which the user is situated may not be aligned with the official time zone time. This is, for example, the case of Switzerland, which although within the Greenwich time zone, has a one hour time difference with the official time zone time.

Other countries have only one official time but their territory covers several time zones.

Finally, some countries change time according to the season (summer time/winter time).

By way of example, for someone in Neuchâtel (Switzerland) on 23 July, the sun will be at its zenith at 14:38 hours in civil time, namely: 12 hours (time zone time), +2 hours (summer time) −28 minutes (longitude of Neuchâtel: 7°) +6 minutes (difference from running equation of time). Conversely, for someone in London on the same day, the sun will be at its zenith at 13:06 hours in civil time, namely: 12 hours (time zone time) +1 hour (summer time) +0 minutes (longitude of London: 0°) +6 minutes (difference from running equation of time). Yet Neuchâtel and London are in the same time zone.

FIGS. 1, 2 and 3 annexed to this patent application illustrate the prior art differential device to which the universal running equation of time mechanism of the invention applies.

This differential device is described in detail in European Patent Application No 1286233 in the name of Frederic Piguet S. A. Let us recall that FIGS. 1, 2 and 3 annexed to this patent application and taken from the aforementioned European patent application, show, in particular, the equation of time cam 1 whose profile is determined by the difference, for each day of the year, between mean solar time or civil time and true solar time.

Indeed, as is well known, there is a difference between true solar time, which is the time that elapses between two consecutive passages of the sun above the meridian at the same location, and mean solar time or civil time which is the mean duration in a year of all the true solar days. This difference between civil time and true time reaches +14 minutes 22 seconds on 11 February and −16 minutes 23 seconds on 4 November. These values vary very little from year to year.

The equation of time cam 1 is driven in rotation at the rate of one revolution per year from the simple or perpetual date mechanism comprised in the timepiece. Cam 1 carries a month disc 2 which rotates at the same speed than cam 1 and which allows to match the position of said cam 1 to the date indicated by the date mechanism so that the solar time minute hand 4 indicates the exact solar time.

The simple or perpetual date mechanism may be of any known type and will not be described in its entirety here. For a clear understanding, it is sufficient to know that this date mechanism drives equation of time cam 1 at the rate of one complete revolution per year. However, purely for the purpose of illustration, a date wheel set 6 driving a hand 8 which indicates the date (from 1 to 31) is shown. This date wheel set 6 rotates at the rate of one complete revolution per month. It is actuated by the date mechanism via an intermediate return date wheel 10 for reversing the direction of rotation, and a reduction wheel set 12 for reducing the rotational speed from one complete revolution per month to one complete revolution per year.

The solar time minute hand 4 is driven by a differential gear 14 which has as respective inputs a gear train 16 driving a civil time minute hand 18 and a rack 20 which cooperates with equation of time cam 1 (rack 20 is shown in FIG. 1 in both of its end positions, once in a full line and the other time in dot and dash lines). More specifically, as seen in FIG. 1, differential gear 14 includes at least one and preferably two planetary wheels 22 driven by the motion work of the watch movement. These two planetary wheels 22 are capable of rotating on themselves and rolling over the inner toothing 24 of an equation of time wheel 26. The latter also has, on the external periphery thereof, a first toothed sector 28 via which it cooperates with a second toothed sector 30 comprised on one of the ends of rack 20. This rack 20 is subjected to the return action of a spring (not shown) which is fixed to the watch frame and which tends to apply a feeler spindle 32, forming the other end of said rack 20, against the periphery of running equation of time cam 1. The solar time display train includes a pinion 34 placed at the centre of differential gear 14 and carried by an arbour 36. This solar time display pinion 34 meshes with planetary pinions 22. It also carries a display wheel 38 which meshes with a cannon-pinion 40 onto the pipe of which there is driven the solar time minute hand 4. This gear train 38, 40 returns the solar time display to the centre 42 of the watch movement, so that the solar time minute hand 4 is concentric with civil time minute hand 18.

The running equation of time mechanism which has just been described operates as follows.

In the normal operating mode of the watch, equation of time cam 1, equation of time rack 20 and thus equation of time train 26 are immobile.

However, planetary pinions 22 are driven by the watch movement. Thus, they rotate on themselves and roll over the inner toothing 24 of equation of time wheel 26, driving solar time pinion 34 in rotation, which permits the solar time minute hand 4 to rotate in a concomitant manner with civil time minute hand 18. The difference between solar time hand 4 and civil time hand 18 thus remains constant over a period of 24 hours.

Once per day, at around midnight, the running equation of time cam 1 pivots, driven by the date mechanism which changes the date from one day to the following day. At that precise moment, feeler spindle 32, which is in contact with the periphery of cam 1, in turn pivots rack 20. Said rack 20, in pivoting, drives equation of time wheel 26 in rotation. Planetary pinions 22, which are substantially immobile during this brief time interval (they make one complete revolution in one hour), rotate on themselves, driven in rotation by equation of time wheel 26 and in turn drive solar time display pinion 34 so as to precisely set the position of solar time minute hand 4 again.

Thus, the running equation of time mechanism described above can, at any time, display the time difference between mean solar time and true time, by means of a civil time minute hand and a solar time minute hand. This running equation of time mechanism does not, however, indicate the civil time at which the sun is at its zenith according to the position, in terms of longitude, of the user within the time zone.

SUMMARY OF THE INVENTION

It is an object of the present invention to overcome this problem by providing a running equation of time mechanism capable of indicating the difference in hours and minutes between civil time and true time, at any time and regardless of the position of the user, in terms of longitude, relative to the centre of the time zone in which he is situated.

The present invention therefore concerns a universal running equation of time mechanism including a differential device, whose first input is formed by a cannon-pinion for the minutes of civil time, and whose second input is formed by a running equation cam, the differential device outputting a running equation minute which indicates the difference, for a given day, between civil time and solar time, the running equation minute driving a true running equation minute which, via a true equation motion work, drives a true running equation hour, the cannon-pinion for the civil time minutes driving, via a motion work wheel set, a civil time hour wheel, a jumper spring, integral with the true running equation hour wheel, cooperating with a star wheel having twelve teeth connected to an arbour carrying a true running equation hour hand, a time zone wheel being also integral with the arbour carrying the true running equation hour hand, a time difference and display train coupled to the true equation motion work for applying, to the true running equation hour, the time difference associated with the position of a user, in terms of longitude, relative to the centre of the time zone in which the user is located, the time zone wheel making it possible to apply the time difference between the true running equation hour and the civil hour at the place where the user is situated forwards or backwards in one hour steps to the arbour carrying the true running equation hour hand.

Owing to these features, the present invention provides a universal running equation of time mechanism which is not only capable of displaying the difference between civil time and solar time, but is also capable of taking account of the difference between civil time and the solar time inherent to the position of the user, in terms of longitude, relative to the centre of the time zone in which the user is situated. Thus, the universal running equation of time mechanism of the invention can display, at any time, the difference in hours and minutes between civil time at the location within the time zone where the user is situated and solar time.

BRIEF DESCRIPTION OF THE DRAWINGS

Other features and advantages of the present invention will appear more clearly from the following detailed description of one embodiment of the universal running equation of time mechanism according to the invention, this example being given solely by way of non-limiting illustration with reference to the annexed drawing, in which.

DETAILED DESCRIPTION OF THE INVENTION

The present invention proceeds from the general inventive idea which consists in providing a universal running equation of time mechanism which, for the display of solar time, takes account not only of the difference between the civil minute and solar minute, but also of the difference associated with the position of the user, in terms of longitude, relative to the centre of the time zone in which the user is situated, and of the difference associated with any time difference between the civil time of the place where the user is situated and the official time at the centre of the time zone.

Figure 1:
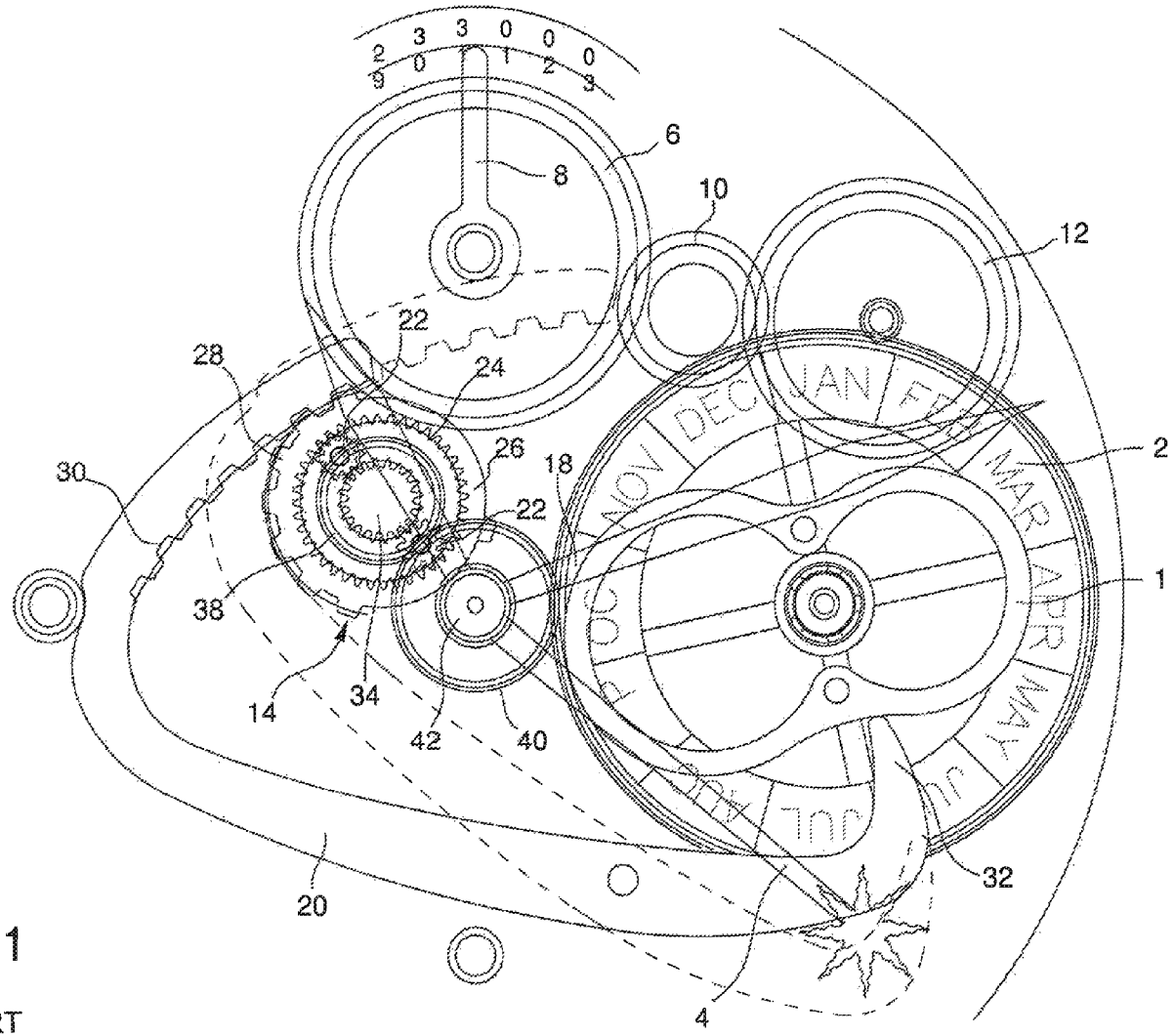
Fig. 1 PRIOR ART
FIG. 1, cited above, is a plan view of the running equation of time device to which the universal running equation of time mechanism of the invention applies.
Figure 2:
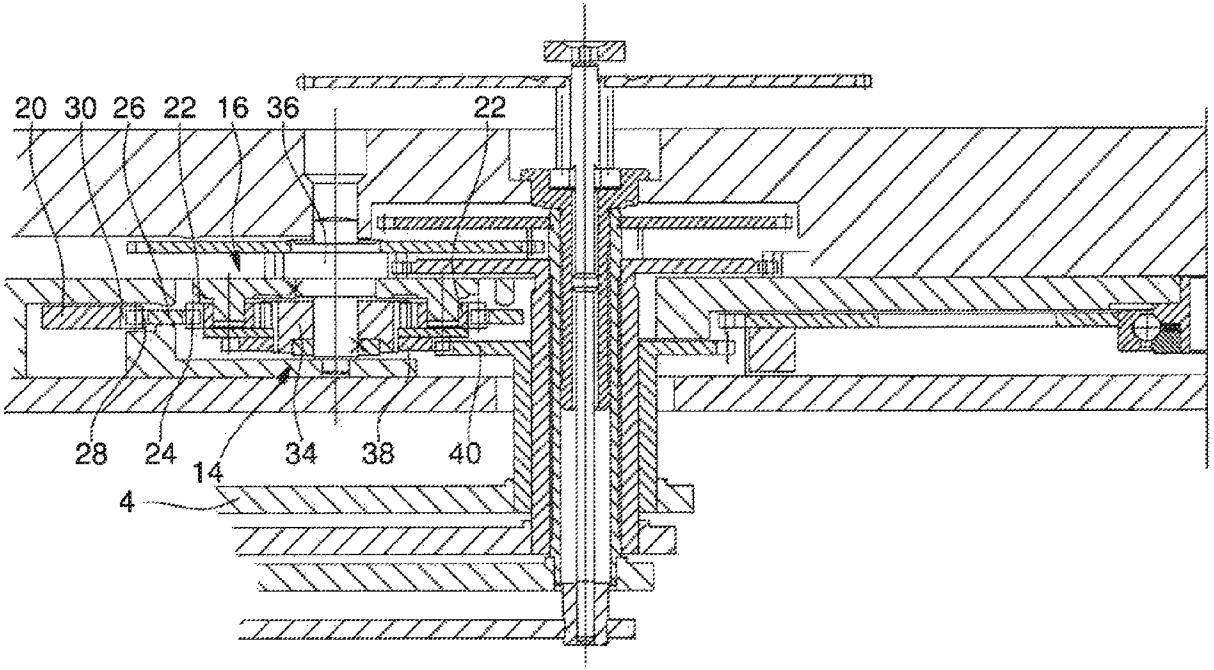
Fig. 2 PRIOR ART
FIG. 2, cited above, is a first cross-section of the running equation of time mechanism shown in FIG. 1.
Figure 3:
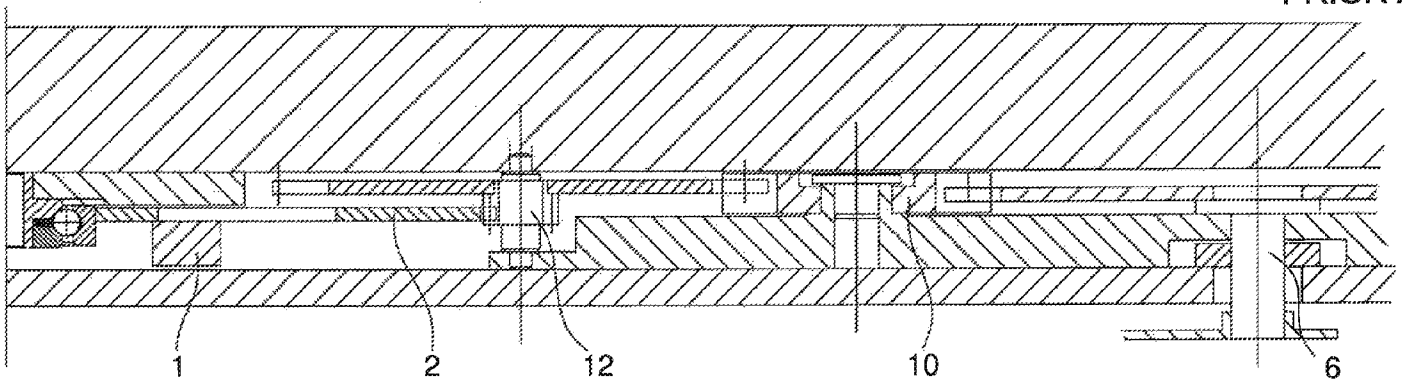
Fig. 3 PRIOR ART
FIG. 3, cited above, is a similar cross-section to that of FIG. 2 in which part of the date mechanism is shown.
Figures 4A, 4B, 4C:
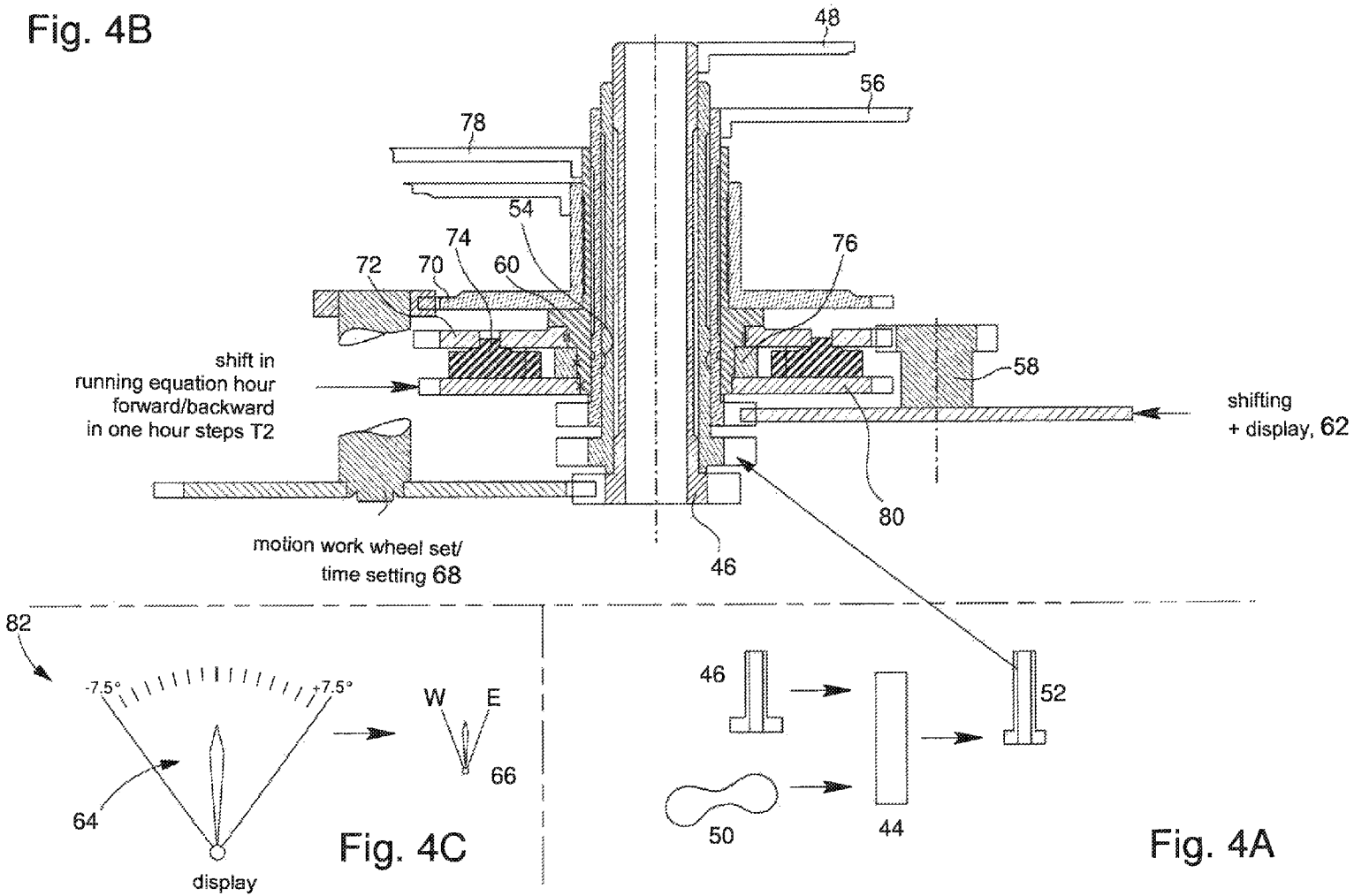
FIGS. 4A, 4B and 4C illustrate a first embodiment of the universal running equation of time mechanism according to the invention.

FIGS. 4A, 4B and 4C illustrate a first embodiment of the universal running equation of time mechanism according to the invention.

Figures 5A, 5B, 5C:
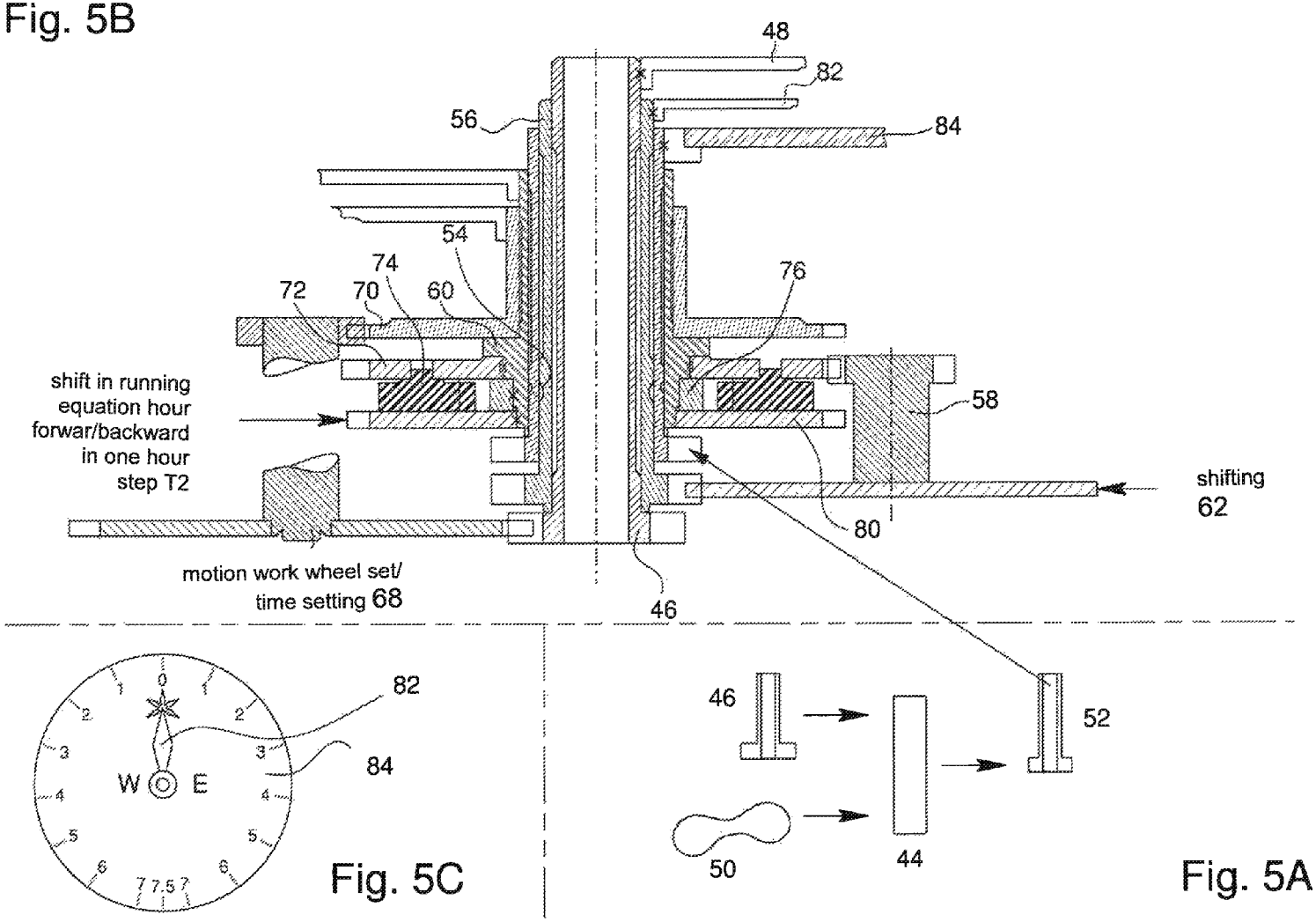
FIGS. 5A, 5B and 5C illustrate a second embodiment of the universal running equation of time mechanism according to the invention.

FIGS. 5A, 5B and 5C illustrate a second embodiment of the universal running equation of time mechanism according to the invention.

FIG. 4A is a diagram of a running equation of time mechanism according to the prior art including a differential device 44 whose respective inputs are a cannon pinion 46 driving a civil time minute hand 48 and an equation of time cam 50. Differential device 44 outputs a running equation minute 52. As mentioned above, running equation minute 52 indicates the difference, for a given day, between civil time and solar time. This difference between civil time and solar time reaches +14 minutes 22 seconds on 11 February and −16 minutes 23 seconds on 4 November.

Added to the difference between civil time and solar time is the difference associated with the position of the user, in terms of longitude, relative to the centre of the time zone in which the user is situated. Indeed, the width of a time zone is 15°, which corresponds to a period of one hour, so that the sun enters the time zone 30 minutes before the official time zone time and leaves 30 minutes after the official time zone time.

This is why, as shown in FIG. 4B annexed to this patent application, the running equation minute 52 drives by friction (indentation) a true running equation minute 56. This true running equation minute 56 differs from running equation minute 52 in that it not only takes account of the difference, for a given day, between civil time and solar time, but also of the position of the user, in terms of longitude, relative to the centre of the time zone in which the user is situated. True running equation minute 56 in turn drives, via a true equation motion work 58, a true running equation hour 60.

A gear train 62 actuatable by the user is coupled to true equation motion work 58. According to a variant embodiment, gear train 62 is directly coupled to true running equation minute 56. This gear train 62 shifts the true running equation minute and hour respectively 56 and 60 according to the position of the user, in terms of longitude, relative to the centre of the time zone in which the user is situated. Thus, as illustrated in FIG. 4C annexed to this patent application, gear train 62 carries one or two indications. A first wheel 64 of gear train 62 carries the indication ±7.5° of the difference in position of the user relative to the centre of the time zone (in the knowledge that each time zone has a width of 15°) and, optionally, another wheel 66 of gear train 62 may carry an east or west indication of the time difference relative to the centre of the time zone.

The introduction of a winter time or summer time or even a different time from the official time zone time will now be considered with reference to FIG. 4B.

The watch according to the invention is fitted with at least one winding stem (not shown) which, in a pushed-in position, enables the watch to be wound and which, in a first pulled-out position, enables the date indication to be set. As will be seen below, in a second pulled-out position T2, the winding stem makes it possible to adjust the difference between civil time at the place where the watch user is situated and the official time at the centre of the time zone, and in a third pulled-out position T3, the winding stem enables the time of the watch to be set, i.e. setting the watch to the time of the place where the watch user is situated.

The cannon-pinion 46 which carries civil minute 48 drives, in a ratio of 1:12, via a motion work wheel set 68, a wheel 70 for the civil time hours. The time of the watch is set via the winding stem in position T3 and via the motion work wheel set 68. In position T3 of the winding stem, motion work wheel set 68 is acted upon to adjust civil minute 48 and civil hour 70 to make said civil minute and hour coincide with the current time of the place within the time zone where the watch user is located.

In rotating, motion work wheel set 68 drives cannon-pinion 46 which, it should be recalled, forms one of the inputs of differential device 44. Consequently, the rotation of cannon-pinion 46 causes the rotation of running equation minute 52 which in turn drives true running equation minute 56 and true running equation hour 60. At this stage of setting the watch, it will be clear that true running equation minute 52 takes account of the difference, for a given day, between civil time and solar time, and also of the position of the user, in terms of longitude, relative to the centre of the time zone in which the user is situated. The difference between civil time and solar time is provided by differential device 44, while the difference associated with the position of the user, in terms of longitude, relative to the centre of the time zone is programmed by the user by means of gear train 62 which is coupled to true equation motion work 58.

It will be noted that during hand-fitting, i.e. when the various hands are mounted in the factory, it is ensured that the date mechanism is positioned at one of the four days of the year when there is zero difference between civil time and solar time. In that case, when civil hand 48 and civil hand 70 are moved to midday using the winding stem in position T3, the true running equation hour 60 and true running equation minute 56 are also placed at midday.

Once civil minute 48 and civil hour 70 are set to indicate the current time of the place where the watch user is situated by actuating the winding stem in position T3, the difference between civil time and the official time at the centre of the time zone must be programmed. It will be recalled that this difference is associated with the difference between civil time at the location of the user within the time zone and the time at the centre of the time zone. By way of example, for a user located in Switzerland, the difference is +1 hour in winter and +2 hours in summer.

Thus, a true running equation hour wheel 72, rotatably mounted on the arbour of true running equation hour 60, carries a jumper spring 74 driving a star wheel 76 having twelve teeth connected to the arbour of true running equation hour 60. The arbour of true running equation hour 60 also carries a true running equation hour hand 78 and a time zone wheel 80 having the same number of teeth as true running equation hour wheel 72.

The shift in true running equation hour 60 or the change into summer or winter time is achieved via the winding stem in position T2 and via time zone wheel 80 shifting forward or backward in one hour steps, star wheel 76 having twelve teeth moving from one step to the other on jumper spring 74 and completing 1/12th of a revolution with each step.

At this stage, the civil time of the watch has been adjusted to coincide with the time of the place within the time zone where the watch user is located, then the following are programmed: the difference between the civil time minute and the solar time minute, then the difference associated with the longitude position of the user within the time zone, and finally the difference between civil time at the place within the time zone where the watch user is situated and the official time at the centre of the time zone. Finally, the watch displays civil time and the difference between civil time and true solar time.

FIGS. 5A, 5B and 5C annexed to this patent application illustrate a second embodiment of the universal running equation of time mechanism according to the invention. This second embodiment of the invention only differs from the first embodiment of the invention illustrated with reference to FIGS. 4A, 4B and 4C in that a true time minute hand 82 is driven onto the pipe of true running equation minute cannon-pinion 56. This true time minute hand 82 is moved above a difference indicator disc 84 driven onto the pipe of running equation minute cannon-pinion 52. Difference indicator disc 84 carries the indication ±7.5° of the difference in position of the user relative to the centre of the time zone (in the knowledge that each time zone has a width of 15°) and an east or west indication of the difference relative to the centre of the time zone.

More precisely, it is clear that if the user is at the middle of the time zone, the true time minute hand 82 points to the zero marking on difference indicator disc 84. It is also clear that true time minute hand 82 and difference indicator disc 84 are shifted substantially by ±15 minutes relative to civil time minute hand 48, so as to indicate the difference, for a given day, between civil time and solar time. This difference between civil time and solar time reaches +14 minutes 22 seconds on 11 February and −16 minutes 23 seconds on 4 November. Further, true time minute hand 82 is acted on independently of difference indicator disc 84 to programme, via difference and display gear train 62, the east or west longitude difference associated with the position of the user relative to the centre of the time zone. By way of example, let us assume that it is 21 June. On this date, it is known that the civil time minute is two minutes ahead of the solar time minute. Consequently, if the civil time minute hand 48 is pointing to the zero marking, true time minute hand 82 and difference indicator disc 84 will indicate a difference of −2 minutes. If it is also assumed that the user is for example 4° longitude east of the centre of the time zone, only true time minute hand 82 will be acted upon to bring said hand into a position 4° longitude east on difference indicator disc 84. Consequently, if on 21 June the user is 4° longitude east of the centre of the time zone, the civil time minute hand 48 will be at zero, the zero of difference indicator disc 84 will be shifted by −2 minutes relative to civil time minute hand 48 and true time minute hand 82 will be shifted 4° longitude east relative to difference indicator disc 84, i.e. by +16 minutes. Finally, true time minute hand 82 will be shifted by +14 minutes relative to civil time minute hand 48.

It goes without saying that this invention is not limited to the embodiment that has just been described and that various simple alterations and variants can be envisaged by those skilled in the art without departing from the scope of the invention as defined by the claims annexed to this patent application. It will be noted in particular that in position T3 of the winding stem, civil minute 48 and civil hour 70 are acted upon. The winding stem therefore includes a sliding pinion which will act, via a first gear train, on motion work wheel set 68. Likewise, in position T2 of the winding stem, the difference between civil time at the place where the watch user is located and the official time zone time is entered. To achieve this, the sliding pinion of the winding stem acts via a second gear train upon time zone wheel 80.

What is claimed is:

1. An universal running equation of time mechanism comprising: a differential device, wherein a first input of the differential device is formed by a cannon-pinion for the minutes of civil time, and wherein a second input of the differential device is formed by a running equation cam, wherein the differential device outputs on a pipe a running equation minute which indicates the difference, for a given day, between civil time and solar time, wherein the running equation minute pipe drives a true running equation minute pipe which, via a true equation motion work, drives a true running equation hour, wherein the cannon-pinion for the civil time minutes drives, via a motion work wheel set, a civil time hour wheel, wherein a jumper spring, integral with the true running equation hour wheel, cooperates with a star wheel having twelve teeth connected to an arbour carrying a true running equation hour hand, wherein a time zone wheel is also integral with the arbour (60) carrying the true running equation hour hand, wherein a difference and display train coupled to the true equation motion work makes it possible to apply, to the true running equation hour, the time difference associated with the longitude position of a user relative to the centre of the time zone in which the user is located, wherein the time zone wheel makes it possible to apply, to the arbour carrying the true running equation hour hand, in forward or backward steps of one hour, the difference between the true running equation hour and the civil hour at the place where the user is located, wherein the running equation minute pipe drives the true running equation minute pipe by friction, and wherein the running equation minute pipe is connected to the true running equation minute pipe by indenting.

2. The running equation of time mechanism according to claim 1, wherein a first wheel of the difference and display train carries the indication ±7.5° of the difference in position of the user relative to the centre of the time zone.

3. The running equation of time mechanism according to claim 2, wherein another wheel of the difference and display train carries an east, west indication of the difference relative to the centre of the time zone.

4. The running equation of time mechanism according to claim 1, wherein a true time minute hand is driven onto the pipe of the true running equation minute cannon-pinion, wherein the true time minute hand is moved above a difference indicator disc driven onto the pipe of the running equation minute cannon-pinion.

5. A method of setting a universal running equation of time mechanism according to claim 1, the method comprising the steps of:

adjusting the civil time to cause it to coincide with the time of the place within the time zone where the watch user is located;

applying the difference, for a given day, between civil time and true time to the true running equation time;

applying the difference associated with the position of the user, in terms of longitude, relative to the centre of a time zone, to the true running equation time;

applying to the true time hour wheel, in forward or backward steps of one hour, the difference between civil time at the place where the user is located and the time at the centre of the time zone.

* * * * *